US011015885B1

(12) United States Patent
Roth

(10) Patent No.: US 11,015,885 B1
(45) Date of Patent: May 25, 2021

(54) FLAT TOP ARI5 TYPE LOWER RECEIVER

(71) Applicant: Parker Matthew Roth, Naples, FL (US)

(72) Inventor: Parker Matthew Roth, Naples, FL (US)

(73) Assignee: Parker Roth, Naples, FL (US)

( * ) Notice: Subject to any disclaimer, the term of this patent is extended or adjusted under 35 U.S.C. 154(b) by 0 days.

(21) Appl. No.: 16/993,159

(22) Filed: Aug. 13, 2020

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS 10,704,848 B1 * 7/2020 Zeider ..... F41A 3/84
2014/0237878 A1 * 8/2014 Lambert ..... F41A 11/00 42/75.01

* cited by examiner

*Primary Examiner* — J. Woodrow Eldred

(57) ABSTRACT

A flat top ar15 type lower receiver for a firearm.

4 Claims, 10 Drawing Sheets

FLAT TOP ARI5 TYPE LOWER RECEIVER

BACKGROUND

The AR lower receiver is the building block of many modern firearms. While the AR lower receiver is versatile, it does have a significant setback. The buffer tube receiving structure imposes major inherent design limitations for firearms that solely utilize or are compatible with the AR lower receiver. These setbacks include limiting material options for the lower receiver, limiting the bolt carrier group travel in an upper receiver, limiting methods to attach a butt-stock or buffer tube, and limiting the shape and method of production of the upper receiver and its components.

Beyond design limitations for compatible upper receivers, from a manufacturing standpoint, the buffer tube receiving structure also significantly increases the amount of material needed for production. Because the buffer tube receiving structure is significantly higher than the flat upper surface of the lower receiver, it requires a larger block for billet machining and a larger forge for forgings. This increases cost, material size, and machine time.

SUMMARY OF THE INVENTION

This summary intends to introduce a simplified form of concepts further explained in the Detailed Description. The following text is not purposed to identify any claimed subject matter's key or essential features, nor is the summary designed to determine the scope of the claimed subject matter.

The present disclosure provides a new Flat Top AR Type Lower Receiver designed to further the modularity of the AR platform. The Flat Top AR Type Lower Receiver device constructed aims to reduce the limitations set by the AR lower receiver described in the background by removing the buffer tube receiving structure from the lower receiver and continuing the lower receiver top flat surface to the rear of the lower receiver.

Notably, upper receivers may be created unbound by the previous limitations set by AR lower receivers. For example, this Flat Top AR Type Lower Receiver allows the buffer tube or stock assembly to be attached fully or partly to the upper receiver. Further, the Flat Top AR Type Lower Receiver allows for new upper receiver designs with extended bolt carrier group travel to slow cyclical rate and increase reliability.

In one configuration, attachments may be added to the Flat Top AR Type Lower Receiver to make it compatible with standard AR and AR type upper receivers. This allows the same lower receiver to be used with AR upper receivers that require a buffer tube and AR upper receivers that do not require a buffer tube and rely on a Picatinny rail end for rear attachments. The disclosed Flat Top AR Type Lower Receiver also offers cost advantages. In some embodiments, the upper receiver may contain the harsh recoil forces as apposed to the prior art AR lower receiver, which contains the majority of the recoil forces. This would allow the lower receiver to be made out of polymer or thinner metal materials, making it lighter and cheaper to produce.

DETAILED DESCRIPTION

A few of the preferred embodiments disclosed present illustration and description. Understandably, many modifications could be made without escaping the scope of the invention. Skilled artists will appreciate the many inventive concepts that qualify as equivalents under the claims. The embodiments described below do not limit the spirit of the invention nor the claims.

Every figure does not contain every reference number. Terms such as "forward," "rearward," "upper," "lower," "bottom," "top," and "side" are used to reference the orientations of the invention, as shown in the images. One skilled in the art will be able to distinguish how these orientational terms could change during the use of the invention.

Figure 1:
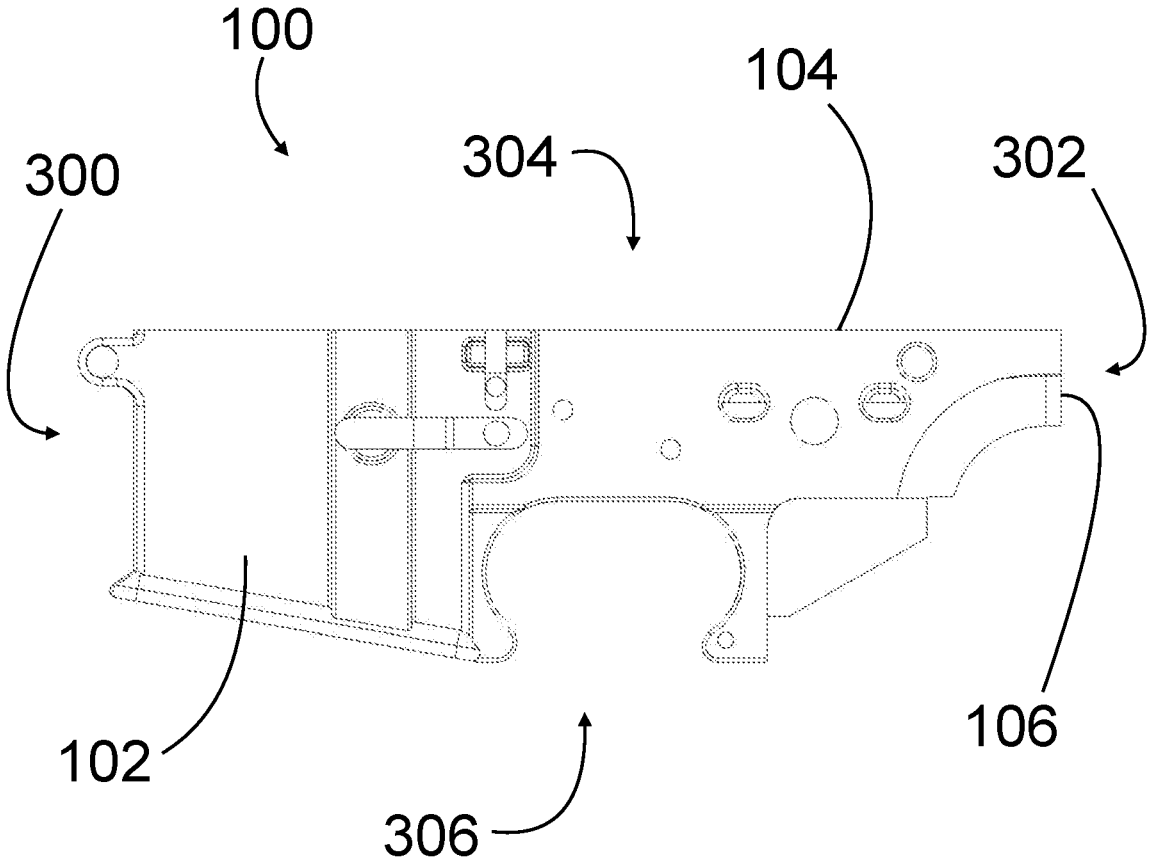
FIG. 1 is a left side elevation view of the Flat Top AR Type Lower Receiver.

FIG. 1 displays an embodiment of a Flat Top AR Type Lower Receiver 100, with a body 102, a forward end 300, a rearward end 302, a top portion 304, and a bottom portion 306. The Top portion 304 of the body 102 contains a flat top surface 104 that continues from the forward end 300 to the rearward end 302 of the body 102 to the rearmost surface 106.

Figure 2:
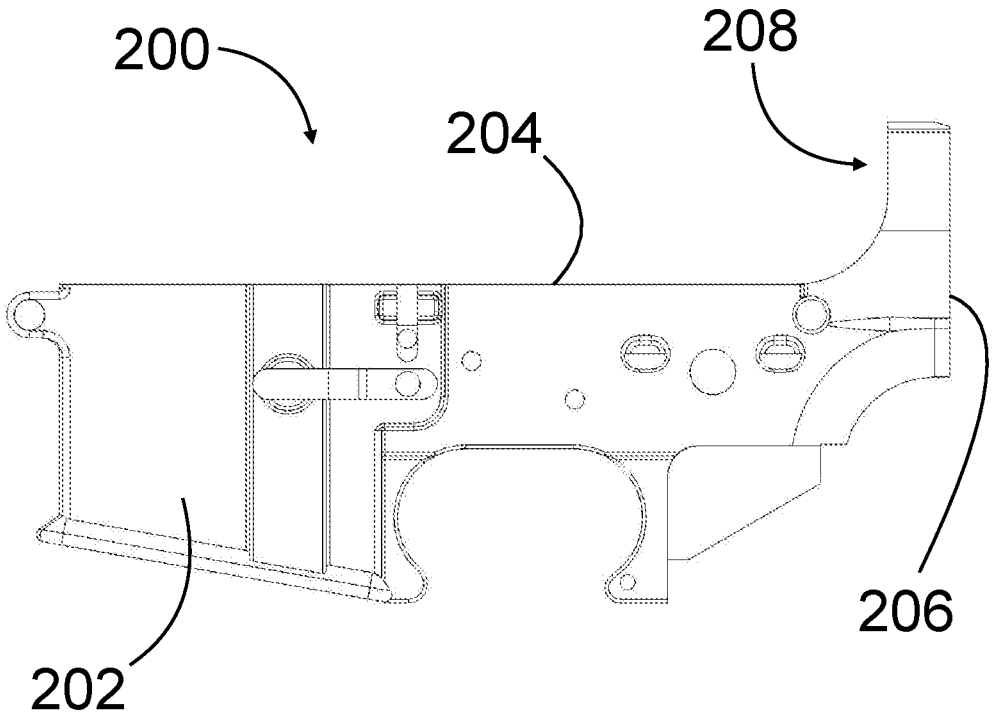
FIG. 2 Prior Art
FIG. 2 is a left side elevation view of an AR lower receiver of the prior art.

FIG. 2 is an embodiment of an AR lower receiver prior art 200, with a body 202, a flat surface 204, a rear surface 206, and a buffer tube receiving structure 208. FIG. 2 serves to illustrate the differences between an AR lower receiver prior art 200 and the Flat Top AR Type Lower Receiver 100 in FIG. 1. The body 102 and the body 202 are similar; the primary difference being that the buffer tube receiving structure 208, or the like, is not included in the body 102 of the Flat Top AR Type Lower Receiver 100. The flat surface 204 is similar to the flat top surface 104; however, the flat top surface 104 continues to the rear of the body, whereas the flat surface 204 dies into the buffer tube receiving structure 208.

Figure 3:
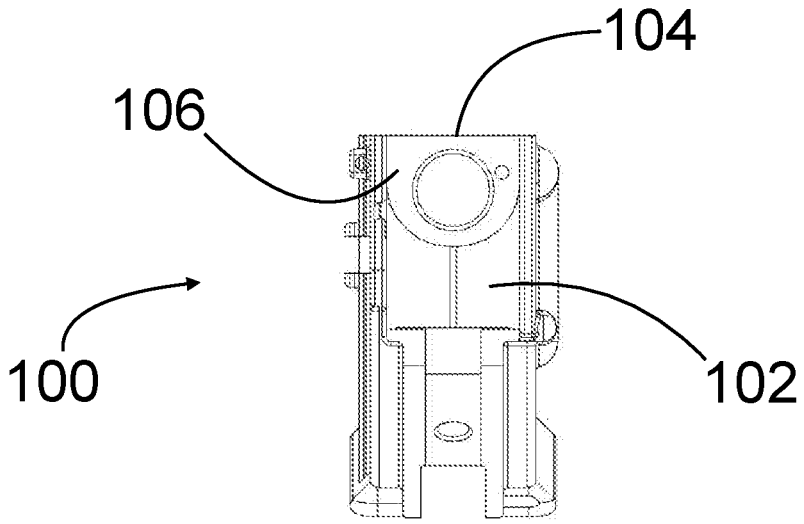
FIG. 3 is a rear elevation view of the Flat Top AR Type Lower Receiver.
Figure 4:
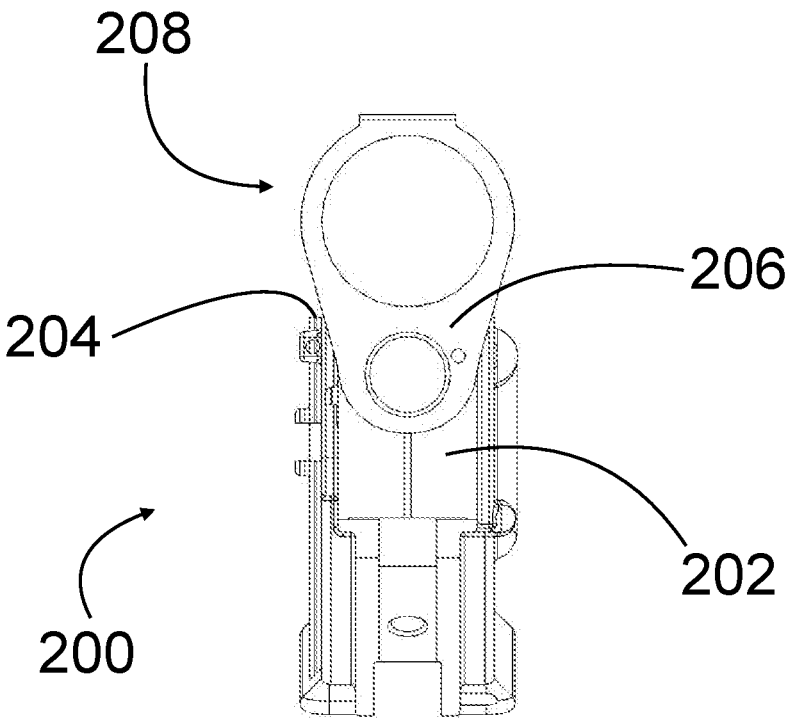
FIG. 4 Prior Art
FIG. 4 is a rear elevation view of an AR lower receiver of the prior art.

FIG. 3 and FIG. 4 are a rear elevation view of an embodiment of the Flat Top AR Type Lower Receiver 100 and the AR lower receiver prior art 200. FIG. 3 and FIG. 4 serve as an additional view of FIG. 1 and FIG. 2 to further the understanding of the invention and how it relates to and differs from the prior art.

Figure 5:
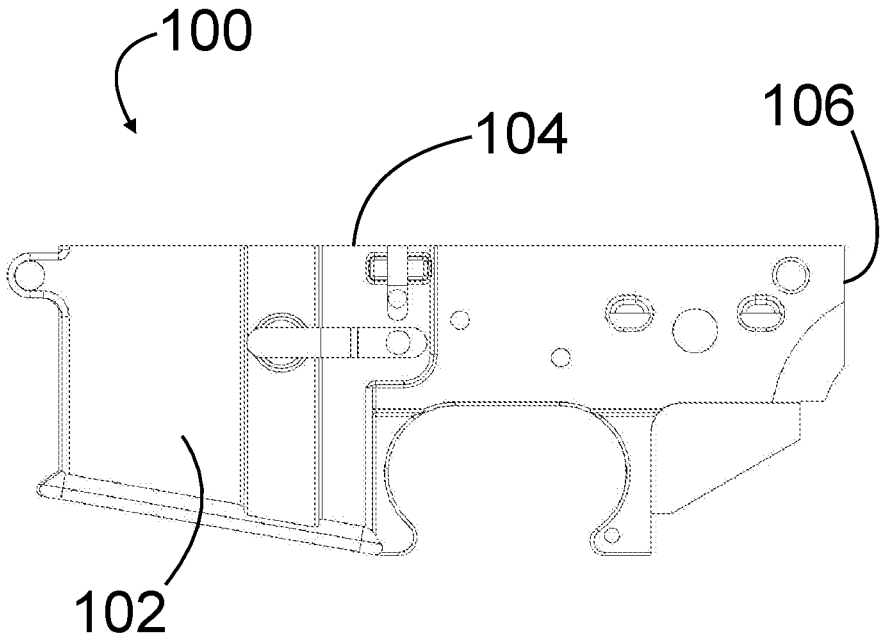
FIG. 5 is a left side elevation view of the Flat Top AR Type Lower Receiver with a shortened rear end.
Figure 6:
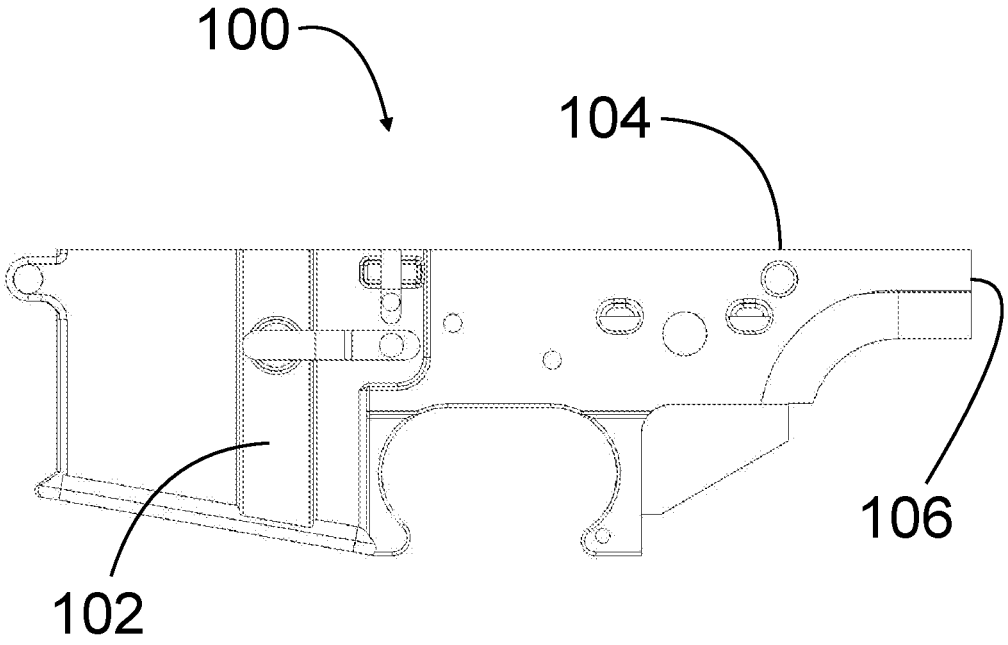
FIG. 6 is a left side elevation view of the Flat Top AR Type Lower Receiver with an elongated rear end.

FIG. 5 and FIG. 6 are embodiments of the Flat Top AR Type Lower Receiver 100. FIG. 5 illustrates an embodiment of the Flat Top AR Type Lower Receiver 100 with a shorter overall body length. FIG. 6 illustrates an embodiment of the Flat Top AR Type Lower Receiver 100 with a longer overall body length. Although not preferred, these embodiments illustrate how a flat top lower receiver may easily be shortened or lengthened to fit the receivers overall design intentions.

Figure 7:
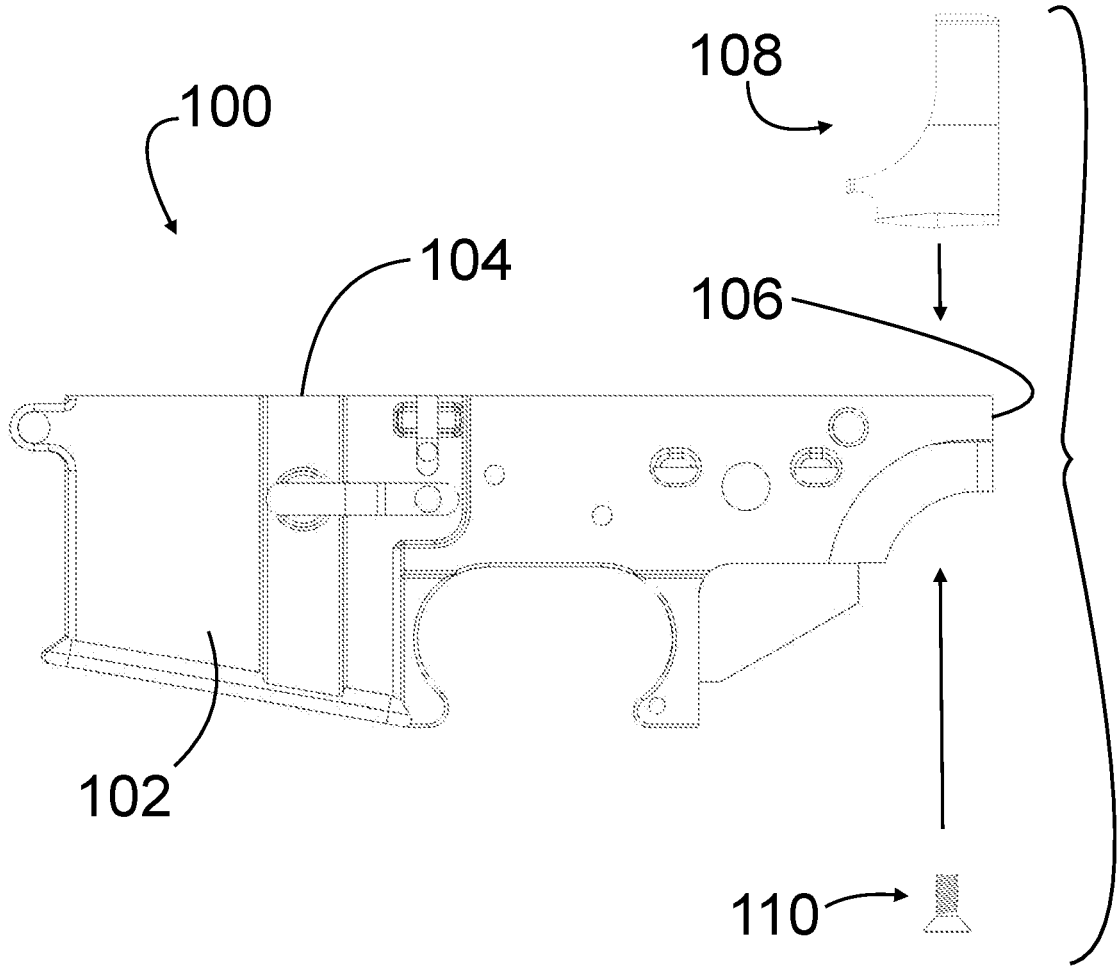
FIG. 7 is a left side elevation view of the Flat Top AR Type Lower Receiver and a buffer tube receiving structure attachment and a fastener.
Figure 8:
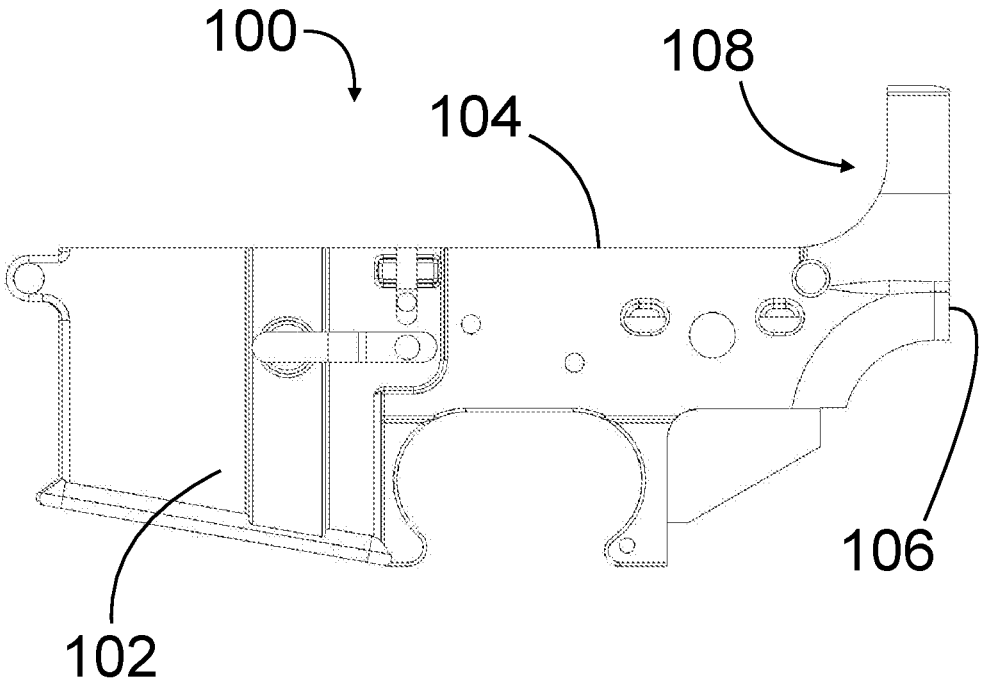
FIG. 8 is a left side elevation view of the Flat Top AR Type Lower Receiver and a buffer tube receiving structure attachment and a fastener installed.
Figure 9:
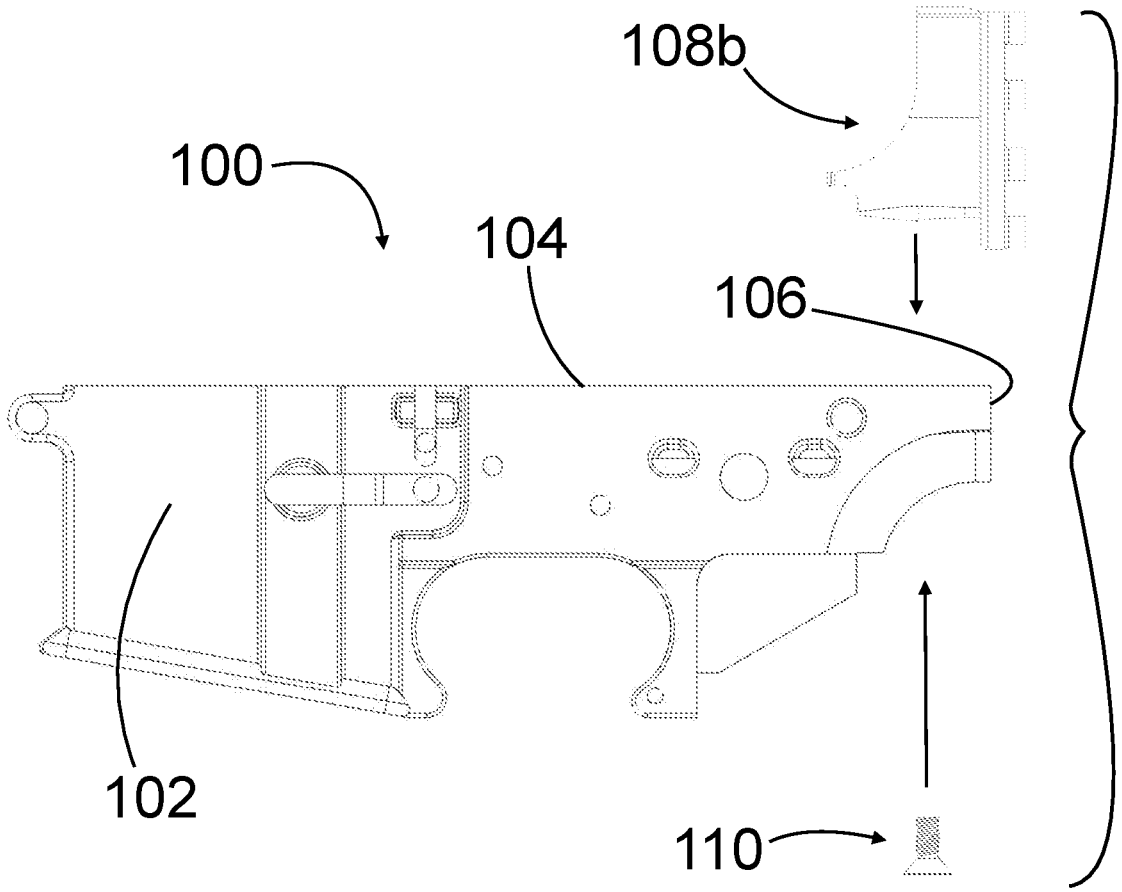
FIG. 9 is a left side elevation view of the Flat Top AR Type Lower Receiver and a Picatinny structure attachment and a fastener.
Figure 10:
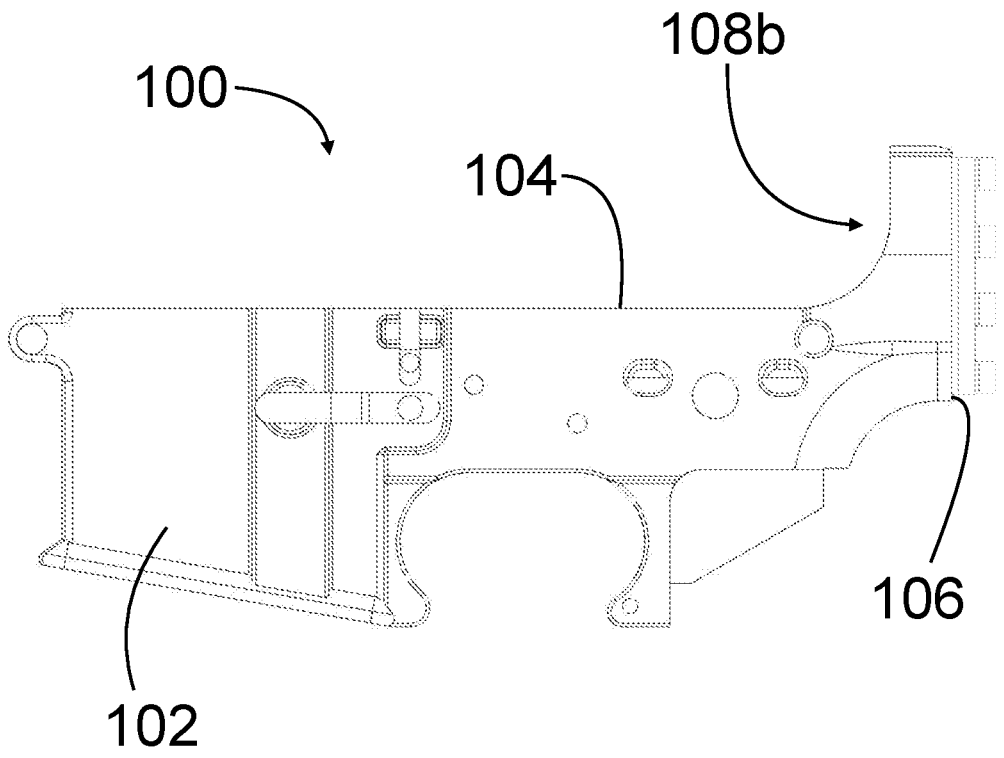
FIG. 10 is a left side elevation view of the Flat Top AR Type Lower Receiver and a Picatinny structure attachment and a fastener installed.

FIGS. 7 through 10 shows the ability for the Flat Top AR Type Lower Receiver 100 to accept different types of attachment structures for compatibility with different upper receivers. FIG. 7 and FIG. 8 illustrate how an embodiment of the Flat Top AR Type Lower Receiver 100 may receive a buffer tube receiving structure 108 attachment as to be compatible with AR upper receivers. FIG. 7 is an exploded left side view with an embodiment of the Flat Top AR Type Lower Receiver 100, a buffer tube receiving structure 108, and a fastener 110. FIG. 8 is an assembled view of FIG. 7. The Fastener 110 attaches the buffer tube receiving structure 108 to the Flat Top AR Type Lower Receiver 100. FIG. 9 and FIG. 10 illustrate how a Flat Top AR Type Lower Receiver 100 may receive a Picatinny rail structure 108*b* as to be compatible with compatible upper receivers. FIG. 9 is an exploded left side view with an embodiment of the Flat Top AR Type Lower Receiver 100, a Picatinny rail structure 108*b*, and a fastener 110. FIG. 10 is an assembled view of FIG. 9. The Fastener 110 attaches the Picatinny rail structure 108*b* to the Flat Top AR Type Lower Receiver 100.

The Fastener 110, although it is illustrated as a machine screw, is not limited to this embodiment or method of attachment. For example, receiving structure 108 and Picatinny rail structure 108*b* may be attached or connected to the Flat Top AR Type Lower Receiver 100 by the two objects being pinned, dovetailed, railed, interlocked, pivot hinged, press fit, taper locked, male and female geometry mated, fitted, friction fit, held in place between the upper receiver and the lower receiver, a combination of these or similar attachment methods not listed.

FIGS. 7 through 10 illustrates the modularity of the Flat Top AR Type Lower Receiver 100 to accept a variety of upper receivers and rear attachments. FIGS. 7 through 10 do not serve to limit the attachments, method of attaching attachments, or limit type of upper receivers compatible with the Flat Top AR Type Lower Receiver 100. One preferred upper receiver for the Flat Top AR Type Lower Receiver 100 is an upper receiver that contains a folding stock or buffer tube assembly.

A preferred embodiment of the Flat Top AR Type Lower Receiver 100 has a flat top surface 104 that is continuous on one plane, as seen in the drawings. However, there may exist embodiments covered under the spirit of the invention with a tapered or stepped flat top surface 104 or rear surface 106. In embodiments a tapered or stepped flat top surface 104 or rear surface 106 may increase strength and or help with alignment for objects that connect to or make contact with the Flat Top AR Type Lower Receiver 100. These tapered or stepped surfaces may go above or below the plane of the flat top surface 104.

Although the illustrated embodiments shown are descriptive of an AR lower receiver, this invention and its claims are intended to extend to pistol caliber AR type receivers, and Larger caliber AR type receivers, or the like. AR type lowers can be identified by their ability to accept AR trigger groups, magazines, and pivot pins that are in locations to accept AR type upper receiver groups. Further, embodiments are not limited to mil-spec AR type lower receivers and extend to improvements to any and all AR type lower receivers. Incomplete AR type lower receivers, such as 80% lower receivers, are also intended to be covered by the spirit and scope of this invention. Those skilled in the art will appreciate the many receiver variations that qualify as AR type lower receivers.

What is claimed is:

1. A Flat Top AR Type Lower Receiver for a firearm, compatible with an AR type trigger assembly and an AR type Take down pin comprising:

A body having a forward end, rearward end, a top portion, and a bottom portion,

Said top portion having a top flat surface,

Said rearward end having a rear most surface,

Said top flat surface extends to the rear most surface uninterrupted by a buffer tube receiving structure.

2. The Flat Top AR Type Lower Receiver of claim 1, wherein said Flat Top AR Type Lower Receiver mechanically connects with an attachment that make the Flat Top AR Type Lower Receiver compatible to mate with a semi-auto AR type upper receiver.

3. The Flat Top AR Type Lower Receiver of claim 1, wherein said Flat Top AR Type Lower Receiver mates with an upper receiver with a rifle stock.

4. The Flat Top AR Type Lower Receiver of claim 1, wherein said Flat Top AR Type Lower Receiver mates with an upper receiver with a pistol brace.

* * * * *